US005483331A

United States Patent [19]

Wayman et al.

[11] Patent Number: 5,483,331

[45] Date of Patent: Jan. 9, 1996

[54] TEXTURED CONTACT ROLLERS AND THE METHOD OF USING THEM FOR IMPROVING ELECTRICAL CONTACT WITH A FUSER BELT FUSING

[75] Inventors: William H. Wayman, Ontario; Rasin Moser, Fairport, both of N.Y.

[73] Assignee: Xerox Corporation, Stamford, Conn.

[21] Appl. No.: 168,835

[22] Filed: Dec. 16, 1993

[51] Int. Cl.[6] ..... G03G 15/20

[52] U.S. Cl. ..... 355/285

[58] Field of Search ..... 355/285, 289, 355/290, 295; 219/216

[56] References Cited

U.S. PATENT DOCUMENTS

| | | | |
|---|---|---|---|
| 3,685,896 | 8/1972 | Kaupp | 355/290 X |
| 4,563,073 | 1/1986 | Reynolds | 355/290 X |
| 4,565,439 | 1/1986 | Reynolds | 355/290 |
| 4,843,214 | 6/1989 | Higashi et al. | 355/290 X |
| 4,937,631 | 6/1990 | Kim et al. | 355/290 |
| 5,084,738 | 1/1992 | Ishikawa | 355/285 |
| 5,157,446 | 10/1992 | Kusaka | 355/285 |
| 5,182,606 | 1/1993 | Yamamoto et al. | 355/289 |
| 5,280,155 | 1/1994 | Ohtsuka et al. | 355/285 X |

*Primary Examiner*—Fred L. Braun

[57] ABSTRACT

Three fuser rollers cooperate with a pressure roller to form an extended fusing zone through which an electrically resistive substrate carrying toner images passes with the toner images contacting fusing belt. Electrical power is applied to the three fuser rolls in such a manner that only the portions of the belt between the rollers are heated. The energy is concentrated only in the part of the fusing belt where it is needed for fusing the toner images on the final substrate. Thus free extent of the belt or in other words the portion of the belt outside of the fusing zone remains unheated. To ensure good electrical contact in the presence of silicone oil contamination on the inner surface of the fusing belt the contact rollers are textured by knurling, bead blasting or other suitable techniques. Such treatment produces high and low surface areas, the former providing the good electrical contact.

16 Claims, 3 Drawing Sheets

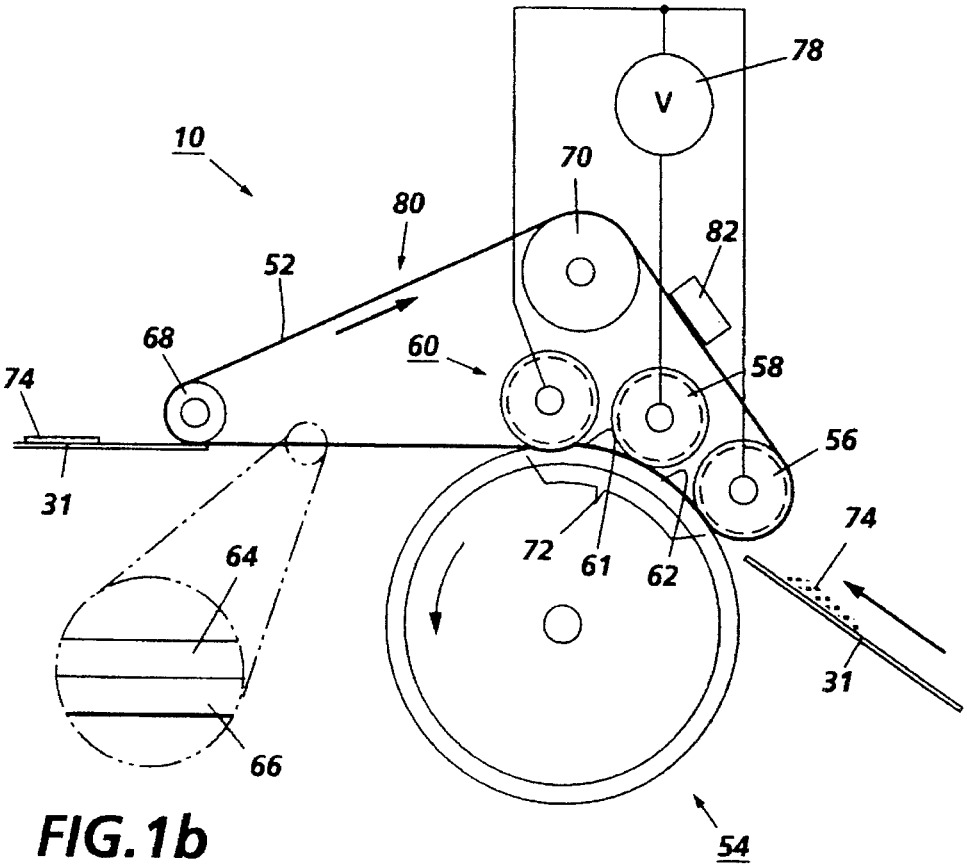
FIG.1b
FIG.1a
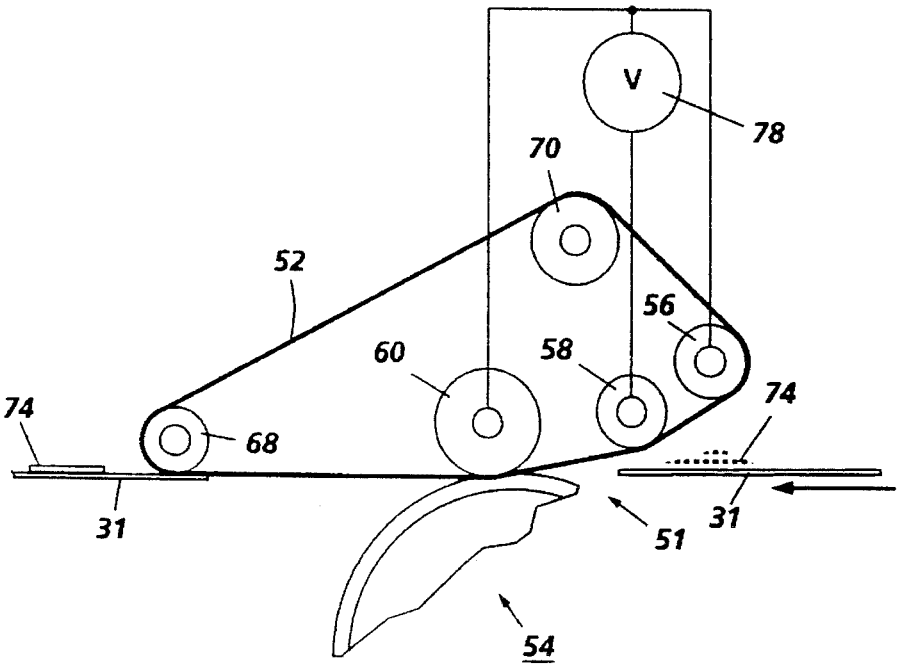
FIG. 2

TEXTURED CONTACT ROLLERS AND THE METHOD OF USING THEM FOR IMPROVING ELECTRICAL CONTACT WITH A FUSER BELT FUSING

BACKGROUND OF THE INVENTION

This invention relates to the art of forming powder images and, more particularly, to heat and pressure belt fuser apparatus.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. However, such image generation electronic and optic devices form no part of the present invention.

In the case of a reusable photoconductive surface, the pigmented resin, more commonly referred to as toner which forms the visible images is transferred to a substrate such as plain paper. After transfer the images are made to adhere to the substrate using a fuser apparatus. To date, the use of simultaneous heat and contact pressure for fusing toner images has been the most widely accepted commercially, the most common being ones that utilize a pair of pressure engaged rolls.

Certain publications and patent applications noted as being possibly relevant to certain aspects of the present invention will now be discussed.

U.S. Pat. No. 4,565,439 granted to Scott D. Reynolds on Jan. 21, 1986 relates to a belt fuser for fusing toner images. The fusing apparatus is characterized by the separation of the heat and pressure functions such that the heat and pressure are effected at different locations on a thin flexible belt forming the toner contacting surface. A pressure roll cooperates with a non-rotating mandrel to form a nip through which the belt and copy substrate pass simultaneously. The belt is heated such that by the time it passes through the nip its temperature together with the applied pressure is sufficient for fusing the toner images passing therethrough. The non-rotating mandrel is adapted to having its axis skewed relative to the axis of the pressure roll. A pair of edge sensors are provided for activating a mandrel skewing mechanism. Skewing of the mandrel by such mechanism effects proper belt tracking.

U.S. Pat. No. 4,563,073 granted to Scott D. Reynolds on Jan. 7, 1986 relates to a low mass heat and pressure fuser and release agent management system therefor.

U.S. Pat. No. 5,084,738 granted to Noriyoshi Ishikawa on Jan. 28, 1992 discloses a fusing apparatus having an electrically conductive film which moves in contact with a recording material to which a toner image has been transferred, a pressing roller for causing the film to be brought into contact with the recording material and a plurality of electrodes disposed along a nip between the film and the pressing roller at a position opposing this pressing roller. The electrically conductive film heats up substantially only in the nip as the result of an electrical conductance to this electrode. The toner image on the recording material is heated and fixed by the heat generated in the electrically conductive film positioned in the nip. In a modified embodiment of the foregoing fusing device, a fusing film is fabricated using a thin-film conductive layer made by aluminum deposition or the like. The conductive layer is disposed on the side of a base film comprising carbon black added to a polycarbonate that will contact the transfer material on which a picture image is carried. Power is supplied between a first electrode and a second electrode. Joule heat is produced in the thickness direction of the fusing film.

U.S. Pat. No. 5,182,606 granted on Jan. 26, 1993 discloses an image fusing apparatus including a heater; a film movable with a recording material, in which the recording material has a toner image thereon which is heated through the film by heat from the heater; and the film has a heat resistive resin base layer containing inorganic electrically insulative filler material and a parting layer containing electrically conductive filler material.

U.S. patent application Ser. No. 08/169,836 filed on Dec. 16, 1993 which is assigned to the same assignee as the instant invention relates to belt fuser wherein three fuser rollers cooperate with a pressure roller to form an extended fusing zone through which a substrate carrying toner images passes with the toner images contacting a fusing belt. Electrical power is applied to the three fuser rolls in such a manner that only the portions of the belt in the fusing zone are heated to a predetermined operating temperature in accordance with a setpoint temperature. The free extent of the belt or in other words the portion of the belt outside of the fusing zone is adapted to be heated to various operating temperatures in order to produce prints with different gloss as desired.

U.S. patent application Ser. No. 08/169,838 filed on Dec. 16, 1993 now U.S. Pat. No. 5,436,712, which is assigned to the same assignee as the instant invention relates to a power controller, which does not rely on the use of sensors such as thermistors to control the operating temperature of a belt fuser. It features various preset inputs to control: steady state watts/in, cold start boost watts/in, warmup and cooldown time constants.

The controller sets the desired power based on the on-off cycling of the system. There are no sensors used to measure fuser temperature. For a cold start, the steady state plus boost power is used, during warmup the boost level is exponentially decreased at a rate set by a warmup time constant. When at rest (with no applied power) the power setpoint is exponentially increased at a rate set by a cooldown time constant.

U.S. patent application Ser. No. 08/169,802 filed on Dec. 16, 1993 now U.S. Pat. No. 5,450,182, which is assigned to the same assignee as the instant invention relates to a belt fuser for fusing transparencies without having to resort to off-line methods and apparatus. The toner images are heated such that the toner becomes molten in the fuser nip. The toner images on the transparency have time to cool prior to separation from a smooth-surfaced belt.

The peak fusing temperature is significantly higher than used with conventional fusers such as heat and pressure roll fusers. This higher temperature guarantees excellent toner melting and flow thereby producing transparencies with excellent projection efficiency.

U.S. patent application Ser. No. 08/168,833 filed on Dec. 16,1993 now U.S. Pat. No. 5,410,394 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three fuser rolls in such a manner that only the portions of the belt in the fusing zone are heated. Thus, the energy is concentrated only in the part of the fusing belt where it is needed for fusing the toner images on the final substrate.

U.S. patent application Ser. No. 08/168,891 filed on Dec. 16, 1993 now U.S. Pat. No. 5,418,105, which is assigned to the same assignee as the instant invention relates to belt fuser wherein three fuser rollers cooperate with a pressure roller to form an extended fusing zone through which a substrate carrying toner images passes with the toner images contacting fusing belt. Electrical power is applied to the three fuser rolls in such a manner that only the portions of the belt between the rollers are heated. Thus, the energy is concentrated only in the part of the fusing belt where it is needed for fusing the toner images on the final substrate. The free extent of the belt or in other words the portion of the belt outside of the three rollers remains unheated. Toner images are directly formed on or transferred to the unheated portion of the fusing belt. The images carried by the belt are then moved through the fusing zone where the images are simultaneously fused and transferred to a final substrate.

The use of belt fusers, like conventional heat and pressure roll fusers, require the use of release agent materials for preventing toner offsetting to the surface of the member contacting the toner images. Electrically insulative release agents such as silicone oil can migrate to the inside of a belt fuser resulting in the coating of both the belt and the rollers that support the belt for movement in an endless path.

As will be appreciated, in a belt fuser such as the one disclosed in U.S. Pat. No. 5,410,394 a good electrical path between the rollers and the conductive belt is necessary for satisfactory operation thereof, the presence of silicone oil contamination between the rollers and the conductive belt is likely and highly undesirable.

BRIEF SUMMARY OF THE INVENTION

In accordance with the present invention, the contact rollers are textured by knurling, bead blasting or other suitable means to ensure good electrical contact in the presence of silicone oil contamination on the electrically resistive inner surface of the fusing belt.

The textured pattern on the drive roll is preferably designed to tension the belt widthwise in order to minimize wrinkling of the belt. Belt tensioning is accomplished by using a roller which is provided with right and left hand knurling. The high spots created by the knurling also ensure good electrical contact in the presence of silicone oil contamination on the electrically resistive inner surface of the fusing belt.

DETAILED DESCRIPTION OF THE DRAWINGS

FIG. 1*a* is a schematic illustration of a fusing apparatus according to the invention.

FIG. 1*b* shows an enlarged fuser belt segment depicting the multilayered structure of the belt.

FIG. 2 is a schematic illustration of a modified embodiment of the invention illustrated in FIG. 1.

DESCRIPTION OF THE PREFERRED EMBODIMENT OF THE INVENTION

Figure 5:
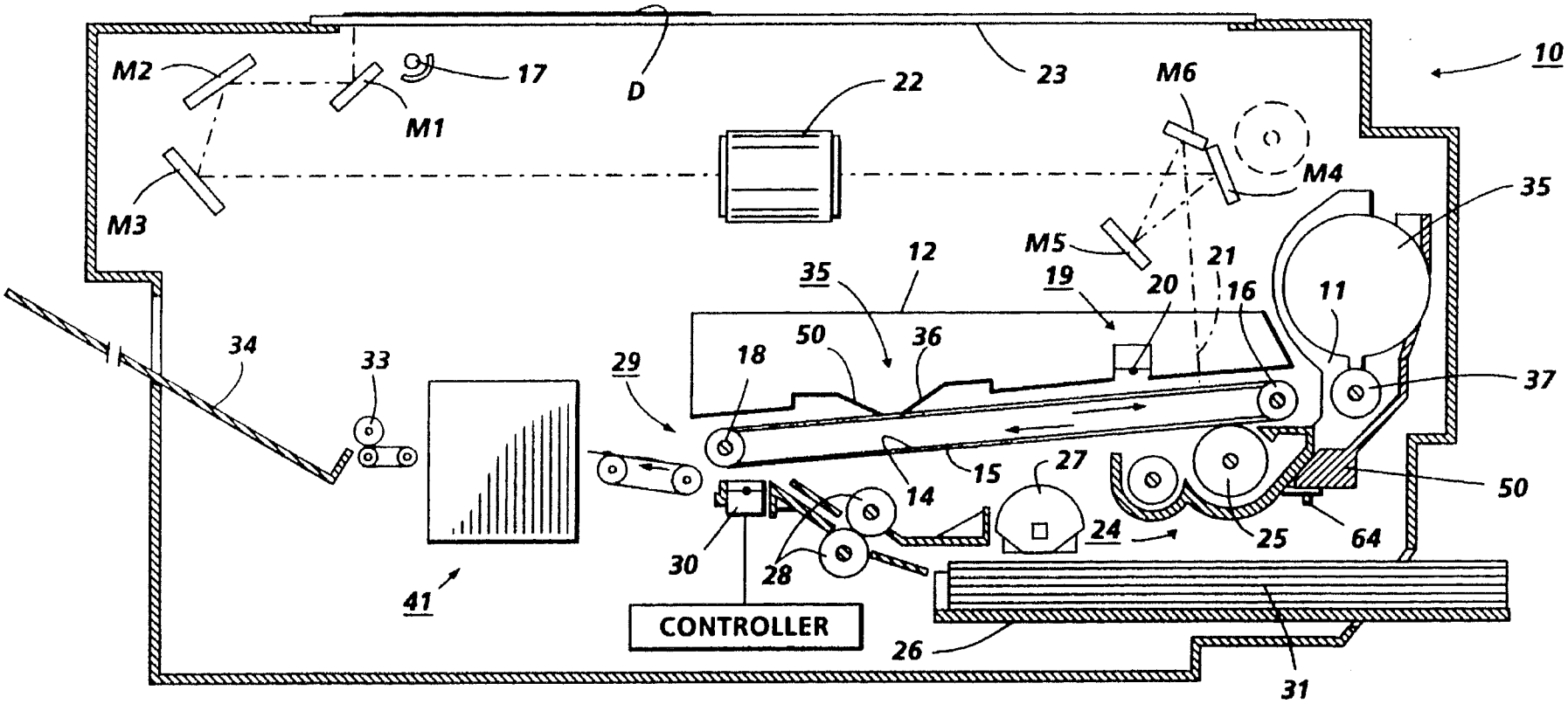
FIG. 5 is a schematic illustration of an imaging apparatus in which the fuser apparatus of FIG. 1 can be utilized.

Referring now to FIG. 5, there is shown by way of example, an automatic electrostatographic reproducing machine 10 which includes a removable processing cartridge 12. The reproducing machine depicted in FIG. 5 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 5 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein toner is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fusing station 41 comprising a seamless, heated fuser belt structure 52, pressure roll 54 and a plurality of fuser roll structures 56, 58 and 60.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scraping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

As disclosed in FIG. 1*a*, the fusing apparatus according to the present invention comprises the seamless belt structure 52 having a resistive polyimide layer 64 and a release layer 66. The belt is entrained about the fuser rollers 56, 58 and 60 as well as a stripping roller 68 and an idler roller 70. The rollers 56, 58 and 60 are electrically conductive contact rollers which are electrically biased for applying voltages across a portion of the belt structure 52 which physically contacts these rollers. By contact is meant that these rollers contact the resistive polyimide layer 64. The use of a seamless belt construction is an important aspect of the invention in that a seamed belt is subject to arcing and wear at each make and break with the contact rollers. When a seamless belt construction is used there is no breaking of electrical contact to the belt thereby eliminating arcing and wear.

The pressure roller 54 cooperates with the rollers 56, 58 and 60 with a portion of the belt disposed therebetween to form a fusing zone 72 through which substrates or sheets 31 carrying toner images 74 thereon are passed for fusing the toner images 74 the substrates. The roller 70 serves as an idler or belt steering roller while the roller 68 serves as a stripping roller. A total nip pressure of approximately 50 lbs. is exerted between the fuser rolls 60 and the pressure roll 54 by conventional structure used for that purpose.

Alternatively, fusing rollers 58 and 56 need not necessarily form a nip with pressure roller 54 as shown in FIG. 2. As illustrated therein a fly-in zone 51 is provided by the positioning of the rollers 56 and 58 as shown in FIG. 2. As will be noted, many of the components from FIG. 1 have been omitted since they are not needed to illustrate the fly-in feature designated by reference character 51.

Figure 3:
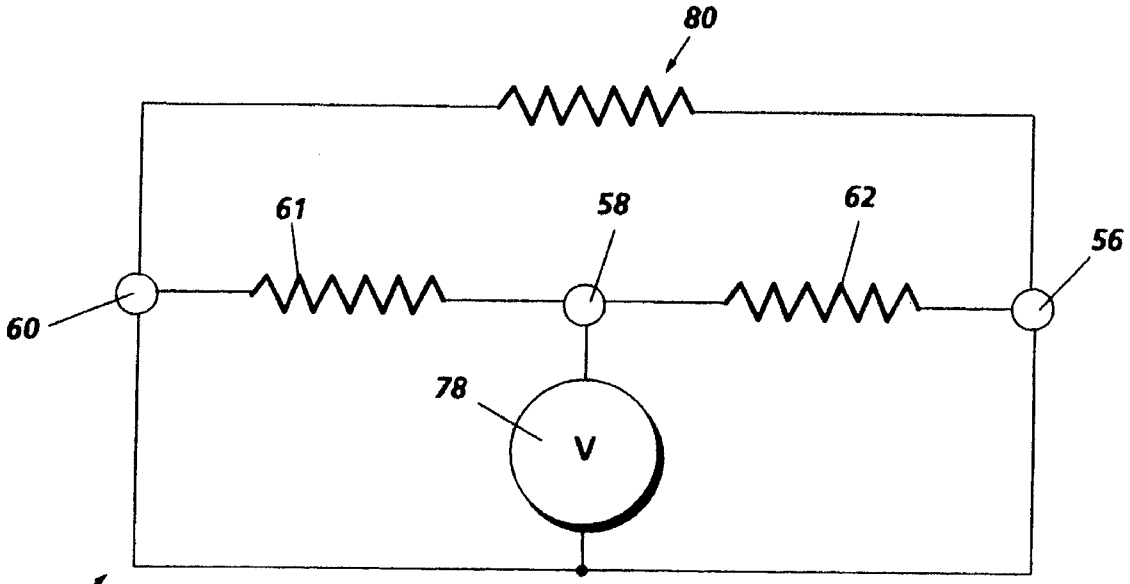
FIG. 3 is a schematic diagram of circuit for enabling the fuser apparatus of FIG. 1 to function in accordance with the present invention.

An electrical circuit 75 for applying power to the heating zones 62 and 61, as disclosed in FIG. 3 comprises an AC power source 78 electrically connected to the three conductive fuser rollers 56, 58 and 60. The voltage is applied between the fusing zone entrance roller 56 and the center roller 58 and between the fusing zone exit roller 60 and the center roller as depicted in FIG. 2. Since the entrance and exit rollers are connected together at equal potential, the non-fusing zone portion or segment 80 which does not contact any of the rollers 56, 58 and 60 is not heated.

A pad 82 containing a suitable release agent material such as silicone oil is supported in wiping contact with the surface of the belt 52. Thus, the belt surface is thinly coated with silicone oil to prevent toner powder particles from adhering to it.

Operation of the above described fuser is implemented using a 50 micron polyimide substrate coated with a 40 micron layer of carbon and graphite loaded fluoropolymer with resistivity of approximately 170 ohms/square. Passing this belt through rollers distanced by 2.25 cm with a voltage differential of 120 VAC developed power of 37 w/cm across the process width. High density (2.0+mg/cm2) color images were well fused at process speeds of 15 cm per second per second, equivalent to 40 copies per minute.

Figure 4:
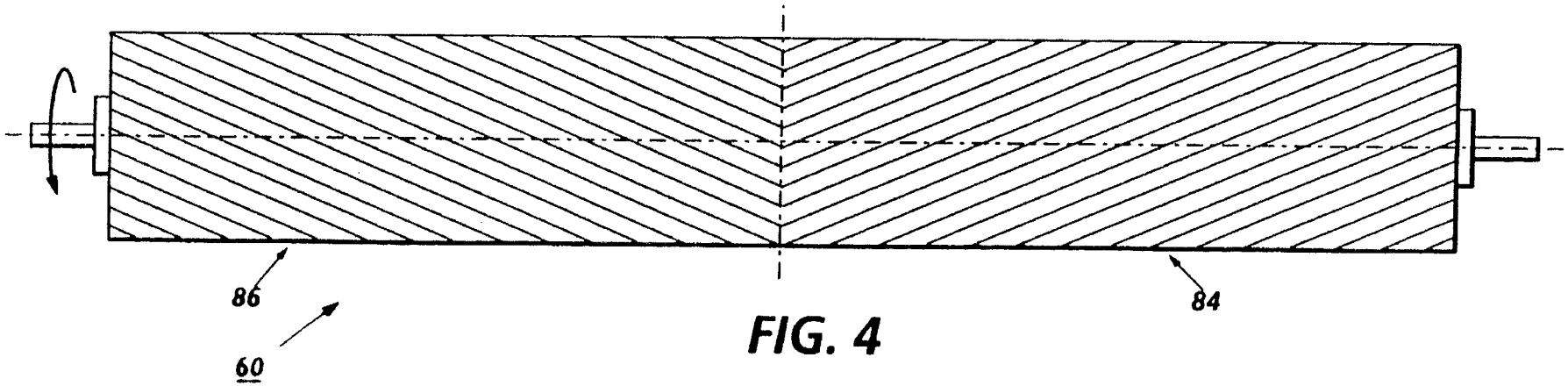
FIG. 4 shows a drive roller according to the invention.

As disclosed in FIG. 4, the drive roller 60 is fabricated such that it comprises a right-hand textured pattern as indicated by reference character 84 and left-hand textured pattern as indicated by reference character 86. The textured pattern is produced by any of a number of well known procedures, for example, knurling. The surfaces of the rolls 56 and 58 are also provided with a knurled-like pattern for enabling good electrical contact with the belt structure 52.

The contact rollers are textured by knurling, bead blasting or other suitable means to ensure good electrical contact in the presence of silicone oil contamination on the inner surface of the fusing belt. Such treatment produces high and low surface areas, the former providing the good electrical contact between the rollers and the belt.

The textured pattern on the drive roll 60 is preferably designed to effect tensioning perpendicular to belt motion or widthwise, in order to minimize wrinkling thereof.

The high spots created by the knurling ensure good electrical contact in the presence of silicone oil contamination on the electrically resistive inner surface of the fusing belt.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A heat and pressure fuser for fusing toner images onto substrates, said fuser comprising:

an electrically resistive belt;

a plurality of electrically conductive rollers for supporting said belt for movement in an endless path;

a pressure roll cooperating with some of said rollers to form an extended fusing zone therebetween;

means for electrically biasing said some of said rollers for effecting heating a segment or segments of said belt in said extended fusing zone;

means for applying release agent material to an outer surface of said belt; and means for effecting good electrical contact between said some of said rollers and said belt in the presence of release agent material.

2. Apparatus according to claim 1 wherein the surfaces of said rollers are non-smooth thereby providing small high surface areas which penetrate release agent material present between the belt and the rollers.

3. Apparatus according to claim 2 wherein the surfaces of said rollers are knurled thereby providing said small high surface areas.

4. Apparatus according to claim 1 including means for effecting tensioning perpendicular to belt motion of said belt as it passes through said fusing zone.

5. Apparatus according to claim 4 wherein the surfaces of said rollers are non-smooth thereby providing small high surface areas which penetrate any release agent material present between the belt and the rollers.

6. Apparatus according to claim 5 wherein the surfaces of said rollers are knurled thereby providing said small high surface areas.

7. Apparatus according to claim 6 wherein the surface of at least one of said rollers is knurled in one direction on substantially one half thereof and knurled in the opposite direction on substantially the other half thereof to thereby effect tensioning perpendicular to belt motion of said belt and penetration of said release agent material for effecting good electrical contact.

8. Apparatus according to claim 7 wherein said release agent material comprises silicone oil.

9. A method using heat and pressure for fusing toner images onto substrates, said method including the steps of;

supporting an electrically resistive belt for movement in an endless path using a plurality of electrically conductive rollers;

supporting a pressure roll in a position to form a fusing zone with some of said rollers;

electrically biasing said some of said rollers for effecting heating of a segment or segments of said belt in said fusing zone;

applying release agent material to the outer surface of said belt; and effecting good electrical contact between said some of said rollers and said belt in the presence of release agent material.

10. A method according to claim 9 wherein said step of supporting an electrically resistive belt comprises using rollers with non-smooth surfaces thereby providing small high surface areas which penetrate release agent material present between the belt and the rollers.

11. A method according to claim 10 wherein the surfaces of said rollers are knurled thereby providing said small high surface areas.

12. A method according to claim 9 including the step of tensioning perpendicular to belt motion said belt as it passes through said fusing zone.

13. A method according to claim 12 wherein the surfaces of said rollers are non-smooth thereby providing small high surface areas which penetrate any release agent material present between the belt and the rollers.

14. A method according to claim 13 wherein the surfaces of said rollers are knurled thereby providing said small high surface areas.

15. A method according to claim 14 wherein the surface of at least one of said rollers is knurled in one direction on substantially one half thereof and knurled in the opposite direction on substantially the other half thereof to thereby effect tensioning perpendicular to belt motion of said belt and penetration of said release agent material for effecting good electrical contact.

16. A method according to claim 15 wherein said release agent material comprises silicone oil.

* * * * *